US005192423A

United States Patent [19]

Duczmal et al.

[11] Patent Number: 5,192,423

[45] Date of Patent: Mar. 9, 1993

[54] APPARATUS AND METHOD FOR SEPARATION OF WET PARTICLES

[75] Inventors: Tomasz Duczmal; Jakob H. Schneider, both of Calgary, Canada

[73] Assignee: Hydro Processing & Mining Ltd., Calgary, Canada

[21] Appl. No.: 817,298

[22] Filed: Jan. 6, 1992

[51] Int. Cl.[5] ..... B03C 1/30; B03D 1/24; B03D 1/14; B04C 3/00

[52] U.S. Cl. ..... 209/164; 209/39; 209/170; 209/211; 261/122.1; 208/391; 208/425; 210/221.2; 210/222; 210/223; 210/512.1; 210/703

[58] Field of Search ..... 209/39, 164, 168, 169, 209/170, 211; 208/390, 391, 425; 261/122; 210/221.2, 703, 787, 788, 789, 695, 222, 223, 512.1

[56] References Cited

U.S. PATENT DOCUMENTS

| | | | |
|---|---|---|---|
| 1,056,318 | 3/1913 | Bruck | 209/211 |
| 3,012,671 | 12/1961 | Ziemer | 209/170 |
| 3,286,844 | 11/1966 | Juell | 209/170 |
| 3,428,175 | 2/1969 | Hukki | 209/170 |
| 3,452,870 | 7/1969 | Katsuta | 210/304 |
| 3,557,956 | 1/1971 | Braun | 209/170 |
| 4,094,783 | 6/1978 | Jackson | 209/170 |
| 4,214,982 | 7/1980 | Pfalzer | 209/170 |
| 4,265,741 | 5/1981 | Im | 209/211 |
| 4,279,743 | 7/1981 | Miller | 209/211 |
| 4,331,534 | 5/1982 | Barnscheidt | 209/170 |
| 4,397,741 | 8/1983 | Miller | 209/170 |
| 4,399,027 | 8/1983 | Miller | 209/164 |
| 4,490,248 | 12/1984 | Filippov | 209/170 |
| 4,512,888 | 4/1985 | Flynn | 209/170 |
| 4,560,474 | 12/1985 | Holik | 209/170 |
| 4,608,155 | 8/1986 | Desportes | 209/224 |
| 4,722,784 | 2/1988 | Barnscheidt | 209/170 |
| 4,744,890 | 5/1988 | Miller | 209/164 |
| 4,838,434 | 6/1989 | Miller | 209/170 |
| 4,876,016 | 10/1989 | Young | 210/512.1 |
| 4,952,308 | 8/1990 | Chamberlain | 209/170 |
| 4,971,685 | 11/1990 | Stanley | 209/170 |
| 4,997,549 | 5/1991 | Atwood | 209/170 |
| 5,022,984 | 6/1991 | Pimley | 209/170 |
| 5,069,751 | 12/1991 | Chamblec | 209/170 |
| 5,114,568 | 5/1992 | Brinsmead | 209/170 |
| 5,116,488 | 5/1992 | Torregrossa | 209/170 |

FOREIGN PATENT DOCUMENTS

| | | | |
|---|---|---|---|
| 1175621 | 8/1964 | Fed. Rep. of Germany | 209/170 |
| 2812105 | 9/1979 | Fed. Rep. of Germany | 209/170 |
| 3524071 | 1/1987 | Fed. Rep. of Germany | 209/170 |
| 15302 | 10/1991 | PCT Int'l Appl. | 209/170 |
| 385622 | 8/1968 | U.S.S.R. | 209/39 |
| 440160 | 9/1972 | U.S.S.R. | 209/170 |
| 545385 | 6/1975 | U.S.S.R. | 209/170 |
| 655432 | 4/1979 | U.S.S.R. | 209/39 |
| 692634 | 10/1979 | U.S.S.R. | 209/170 |
| 1421407 | 9/1980 | U.S.S.R. | 209/39 |
| 1005921 | 3/1983 | U.S.S.R. | 209/169 |
| 1036385 | 8/1983 | U.S.S.R. | 209/39 |
| 1278035 | 12/1986 | U.S.S.R. | 209/170 |
| 1488005 | 6/1989 | U.S.S.R. | 209/39 |
| 1535633 | 1/1990 | U.S.S.R. | 209/39 |
| 2162092 | 1/1986 | United Kingdom | 209/170 |

*Primary Examiner*—Stanley S. Silverman
*Assistant Examiner*—Thomas M. Lithgow
*Attorney, Agent, or Firm*—Basile and Hanlon

[57] ABSTRACT

An apparatus and a process for separating particles in a slurry based on different physical, magnetic and/or chemical properties of the particles, the slurry including a mixture of solid particles and/or liqid particles which are immiscible in the slurry. The process comprises:

tangentially introducing a stream of the slurry into a cylindrical chamber having a cylindrical inner wall with sufficient volume and pressure to develop a vortex in the slurry which extends downwardly from an upper end;

introducing air into the stream during at least a portion of its upward travel, the air being introduced to the stream through means located at the chamber inner wall and for developing the air bubbles which move into the stream;

the chamber being of a height sufficient to allow the stream to develop into a whirlpool at the chamber upper end;

directing the whirlpool stream outwardly at the open end into a catch basin surrounding the open end; and separating the floating air bubbles with lighter hydrophobic particles from the heavier particles by collecting outwardly floating air bubbles with an upper zone of the catch basin.

27 Claims, 4 Drawing Sheets

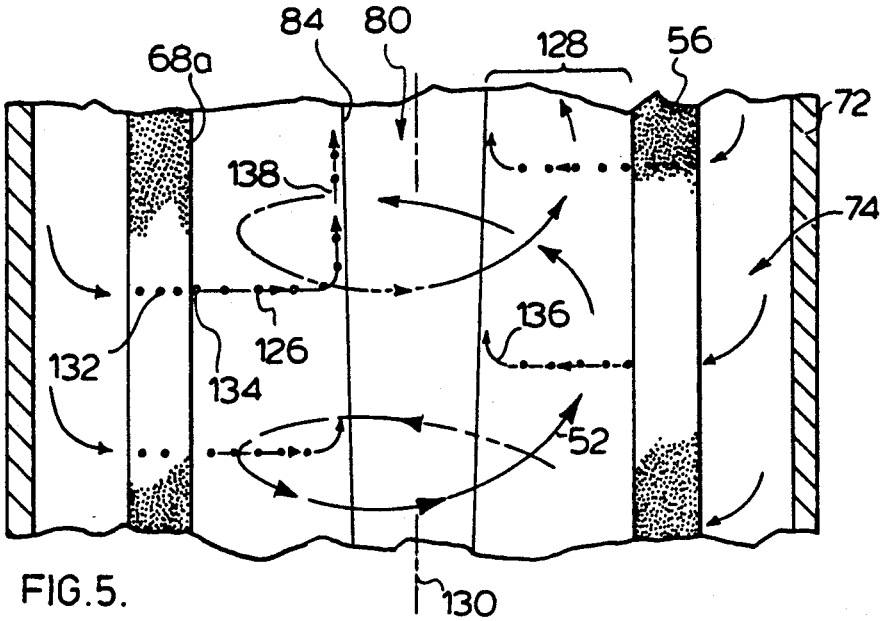
FIG.5.
FIG.6.
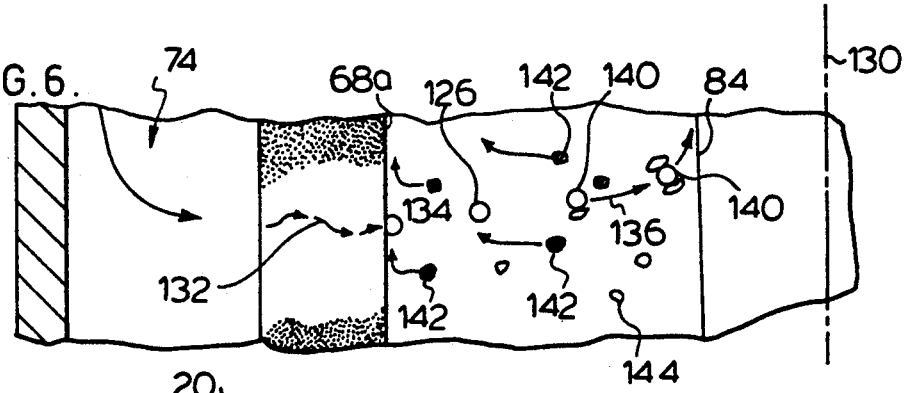
FIG.7.
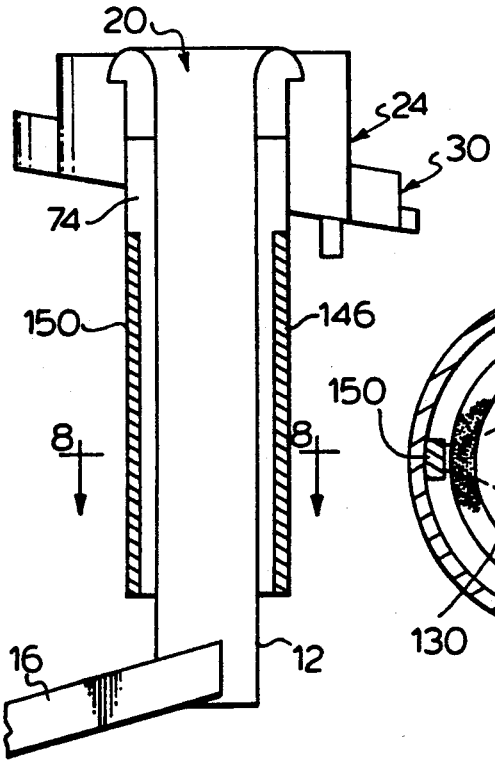
FIG.8.
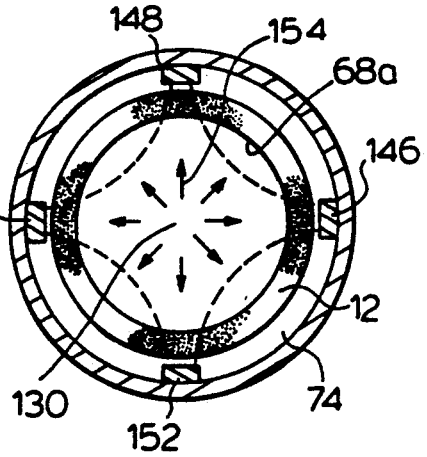

APPARATUS AND METHOD FOR SEPARATION OF WET PARTICLES

FIELD OF THE INVENTION

This invention relates to a process and apparatus for separating particles in a slurry where the particles possess different physical, magnetic and/or chemical properties. More particularly, the process and apparatus is very effective in separating liquid hydrocarbons from water which may contain solids, separation of one or more solids from liquids, separation of mineral ores which may be of ferri-, ferro- and/or para-magnetic properties.

BACKGROUND OF THE INVENTION

Flotation systems are important unit operations in process engineering technology that were developed to separate particulate constituents from slurries. Flotation is a process whereby air is bubbled through a suspension of finely dispersed particles, and the hydrophobic particles are separated from the remaining slurry by attachment to the air bubbles. The air bubble/particle aggregate, formed by adhesion of the bubble to the hydrophobic particles, is generally less dense than the slurry, thus causing the aggregate to rise to the surface of the flotation vessel. Separation of the hydrophobic particles is therefore accomplished by separating the upper layer of the slurry which is in the form of a froth or foam, from the remaining liquid.

The fundamental step in froth flotation involves air bubble/particle contact for a sufficient time to allow the particle to rupture the air-liquid film and thus establish attachment. The total time required for this process is the sum of contact time and induction time, where contact time is dependent on bubble/particle motion and on the hydrodynamics of the system, whereas induction time is controlled by the surface chemistry properties of the bubble and particle.

However, flotation separation has certain limitations that render it inefficient in many applications. Particularly, in the past it has been thought that flotation is not very effective for the recovery of fine particles (less than 10 microns in diameter). This can be a serious limitation, especially in the separation of fine minerals. An explanation for this low recovery is that the particle's inertia is so small that particle penetration of the air-liquid film is inhibited, thus resulting in low rates of attachment to the bubbles. Furthermore, flotation has never been relied on as a process to effect separation of hydrocarbons in a slurry.

A further limitation of conventional flotation systems is that nominal retention times in the order of several minutes are required to achieve successful separation. However, it has been shown that air bubble/particle attachment is frequently in the order of milliseconds, therefore indicating that the rate of separation is mostly limited by bubble-to-particle collisions and/or transport rather than by other factors. As such, these long retention times severely limit plant capacity and require the construction of relatively large and expensive equipment.

Air-sparged hydrocyclones (hereinafter "ASH") were developed to overcome these two limitations of conventional flotation systems. Early systems such as disclosed in Russian Patent 692634 (Oct. 25, 1979) and in German Patent 1,175,621 (Aug. 13, 1964) were relied on to effect separation in a Centrifugal field by introducing air bubbles in the swirling stream. Refinements on this concept have been made such as exemplified in U.S. Pat. Nos. 4,279,743, 4,397,741, 4,399,027 and 4,744,890 which disclose certain improvements in ASH units. ASHs combine flotation separation principles with centrifugal forces to achieve successful separation of finer particles with retention times in the order of several seconds. A controlled high force field is established in the ASH by causing the slurry to flow in a swirling fashion, thereby increasing the inertia of the finer particles. Also, high density, small diameter air bubbles are forced through the slurry to increase collision rates with the particles. The net result is flotation rates with retention times approaching intrinsic bubble attachment times. This corresponds to a capacity that is at least 100 to 300 times the capacity of a conventional mechanical or column flotation unit.

In ASH flotation, fluid pressure energy is used to create rotational fluid motion (swirling motion). This is done by feeding the slurry tangentially through a conventional cyclone header into a cylindrical vessel. A swirl flow of a certain thickness is developed in the circumferential direction along the vessel wall, and is discharged through an annular opening created between the vessel wall and a pedestal located axially on the vessel's bottom.

Air is introduced into the ASH through the jacketed porous vessel walls, and is sheared into numerous small bubbles by the high velocity swirl flow of the slurry. Hydrophobic particles in the slurry collide with the air bubbles, attach to the bubbles, and are transported radially by the bubbles into a froth phase that forms in the cylindrical axis. The froth phase is supported and constrained by the pedestal at the bottom of the vessel, thus forcing the froth to move upward towards the vortex finder of the cyclone header, and to be discharged as an overflow product. The hydropohilic particles, on the other hand, generally remain in the slurry phase, and thus continue to move in a swirling direction along the porous vessel wall until they are discharged with the slurry phase through the annulus opening between the vessel wall and the pedestal.

It is important to note that the swirling motion of the slurry along the vessel wall forms a "swirl-layer" that is distinguishable from the forth phase at the center of the cylindrical vessel. One important characteristic of the swirl-layer is that it has a net axial velocity toward the underflow discharge annulus between the vessel wall and the froth pedestal. The thickness of the swirl-layer is generally 8% to 12% of the vessel radius, and it increases with increasing air flow rate and with axial distance from the cyclone header, being greatest at the underflow discharge annulus.

The size and motion features of the froth formed along the cylindrical vessel's axis are dependent on operating conditions and feed characteristics. Between the swirl-layer and the froth core, there exists a transition region for the slurry, where the net velocity in the axial direction is either zero, or in the same direction as the slurry phase. The latter condition exists where the froth core is relatively small, thus leaving a large gap between the swirl-layer and the froth core track is filled with slurry. The most desirable condition is when the transition region is minimal, that is when the froth core is large enough to leave little space between it and the swirl-layer.

A pressure drop is created in the froth core, between the froth pedestal and the vortex finder outlet located axially at the top of the vessel. This pressure drop is the force that actually drives the froth axially upwards. There are three factors that affect the pressure drop in the forth core:

1. restriction of the slurry flow to the underflow discharge annulus;
2. restriction of the froth transport to the overflow vortex finder opening; and
3. continuous supply of fresh froth to the froth core from the swirl-layer.

Factors 1 and 2 are in turn dependent on the particular application and can be adjusted during the operation. Factor 3 is dependent on air flow rate and on the hydrophobic properties of the particles, and their weight fraction in the feed slurry.

An immediate advantage of the ASH is the directed motion and intimate contact between the particles in the swirl-layer on the porous vessel wall and the freshly formed air bubbles. The high centrifugal force field developed by the swirling slurry imparts more inertia to the fine particles so that they can impact the bubble surface and attach to the bubbles. As a result, separation of fine particles is enhanced.

However, ASHs are relatively poor separators of coarser hydrophobic particles because the velocity of the swirling slurry imparts too high an inertia to these particles, thus preventing these particles from attaching to the air bubbles. As such, to achieve separation of these coarser particles, it is necessary that they exhibit relatively strong hydrophobicity so that the bubble/-particle aggregate are stable under the prevailing hydrocyclone conditions. In cases where hydrophobicity is not strong enough, the system will exhibit some characteristics of a classification cyclone in that the coarse hydrophobic particles will be transported by the slurry to the underflow discharge annulus, while the finer particles will have a tendency to be transported into the froth core and out through the overflow vortex finder.

Studies have shown that the separation efficiency for a number of mineral particles falls as particle diameters increase above 100 microns. However, other studies show that the upper particle size limit is strongly affected by the hydrophobicity of the particle (as discussed above), and thus can be extended beyond 100 microns. For coal particles, testing shows that separations of particles above 100 to 400 microns drops significantly with increasing slurry pressure.

Therefore, an important addition to the art would occur if a method and apparatus is developed that can effectively separate particles of sizes beyond the present range of particle sizes. Also, a significant improvement would occur if increased slurry pressure (therefore increased feed flow rates) can be used while maintaining efficient separation. An important development in the method and apparatus is described in applicant's published application WO 91/15302 published Oct. 17, 1991 with surprising degrees of particle separation involving unique application of separation techniques in an ASH. As a guide in further understanding the principles of separation in the new ASH of applicant, one may refer to the published PCT application. However, as an overview the following principles are discussed to provide a better understanding of the benefits provided by applicant's discovery set out in this application.

A. Froth Flotation

As previously explained, separation of hydrophobic particles is accomplished by separating the upper layer of the slurry which is in the form of a froth or foam from the remaining liquid. Froth flotation has brought applicability of the process with respect to particle size and its effective from 8 to 10 mesh below. More so than for any other separation process, flotation has almost no limitations in separating minerals.

Flotation machines provide the hydrodynamic and mechanical conditions which effect the actual separation. Apart from the obvious requirements of feed entry and tailings exit from cells and banks and for hydrophobic or mechanical froth removal, the cell must also provide for:

1. effecting suspension and dispersion of small particles to prevent sedimentation and to permit contacting with air bubbles;
2. influx of air, bubble formation, and bubble dispersion;
3. conditions favouring particle bubble contact and attachment;
4. a non-turbulent surface region for stable froth formation and removal; and
5. in some cases sufficient mixing for further mineral reagent interaction.

The following lists some of the more important mechanisms occurring in flotation machines.

PULP: Bubble genecies; particle/bubble relative flow path; thinning and rupture of separating liquid films; highly aerated impeller region and less aerated remainder with intense recycle flow between two regions; steep pulp velocity gradients especially in the presence of frothing agent; distribution of residence time of solids.

FROTH: Concentration gradients arising from selective and clinging action of froth column; bubble coalescence; concentration gradients may be represented by layering with step-wise concentration changes and two way mass transfer between the layers.

PULP-FROTH TRANSITION: Two-way solid and liquid mass transfer between phases.

AIR: Proves the motive force for both solids and water transfer from pulp to froth.

WATER: Transported by air and all solids non-selectively at increasing rate with decreasing particle size, into froth column, aids return of solids from froth and pulp by drainage.

The rate of flotation of particle by bubble can be expressed as the product of the probability of collision $P_c$ between the particle and bubble, the probability of attachment $P_a$ between the bubble and particle, the probability of bubble with particle attachment entering froth $P_f$, and the probability of bubble and particle remaining attached throughout the flotation process $P_s$.

$$K=P_c \cdot P_a \cdot P_d \cdot P_s$$

For the most part, the probability of attachment depends upon the surface characteristics of the mineral and the degree of collector adsorption on the mineral surface. It was shown that induction time for attachment decreases as the particle size decreases. Because of the shorter induction time, fine particle should float faster which does not explain the observed decline in flotation efficiency for fine size particles.

The probability of a particle remaining attached to a bubble depends upon the degree of turbulence found in the system. The same forces that drove the particle and bubble together are available to separate them. It was shown that:

$$P_s = 1 - \left(\frac{d_p}{d_{pmax}}\right)^{3/2}$$

Where $d_p$ is the particle diameter and $d_{pmax}$ is the maximum diameter of a particle that will remain attached under the prevailing turbulent conditions. The probability is lowest for coarse size particles and approaches unity for fine size particles. Once attached the probability of remaining particles. Based on these considerations, it appears that for fine particles the poor probability of collision is the main reason for the poor flotation. This means that the hydrodynamic forces are very important for flotation of fine particles.

The probability of collision depends upon the number and size of the particles and the bubbles and the hydrodynamics of the floatation pulp. This probability is directly related to the number of collisions per unit time and per unit volume. The number of collisions in flotation systems can be represented by the formula:

$$N_c = 5 - N_p \cdot N_b \cdot r_{bp} \cdot (V^2{}_b + V^2{}_p)^{\frac{1}{2}}$$

Where $N_p$ is the number of particles, $N_b$ is the number of bubbles, $r_{bp}$ is the sum of the particles and the bubble radii, and $V_b{}^2$ and $V_p{}^2$ are a means square of the effective relative velocity between the particles and bubbles. From the equation, it can be seen that by increasing the number of bubbles and the relative velocity of the bubbles and particles, the number of collisions can be increased for a given pulp.

The final factor affecting the flotation rate constant k is bubble loading Bubble loading is not yet well understood, but it essentially limits the capacity of the bubbles to carry particles out of the flotation cell. As the feed rate increases for a given aeration rate, the bubbles become more fully loaded. When the bubbles become more than 50% loaded, $P_s$ decreases as the bubbles become particle residence time on the bubble is shortened and as the available bubble surface for attachment is reduced. The net effect is a decrease in the volume of k. In addition, bubble loading may also influence the coalescence of bubbles with the flotation cells, which would have a much more pronounced effect on k.

After the flotation rate constant, the retention time of particles in the flotation cell has the most significant impact on flotation recovery. Retention time is determined by dividing the effective volume of the flotation cell (corrected for air hold-up) by the flow rate of the liquids in the slurry entering or exiting the flotation cell. Thus all three parameters, flotation cell volume, liquid slush/slurry flow, and air hold-up, play a role in determining the retention time of the flotation cells. Conventional froth flotation is very effective for particles down to 20 micrometers in size, but the flotation efficiency drops off as the particle size decreases below 20 micrometers.

B. Radial Gravity Separation

Gravity concentration may be defined as that process where particles of mixed sizes, shapes, and specific gravities are separated from each other by the force of gravity or by centrifugal force. The nature of the process is such that size and shape classification are an inherent part of the process in addition to separation on the basis of specific gravity from whence the process got the name. For coarse size minerals, efficient specific gravity separation has been possible for many years with open-bath vessels using the natural settling velocity or buoyancy of the particles. If vessel size remains within an economical limit, the particles in the bath vessels must have high setting rate in a 1G gravitational field. To extend a sufficient specific gravity separation of smaller sizes, the gravitational acceleration of particles is replaced by artificial radial gravity field sometimes called centrifugal field. The settling of small particles in a centrifugal force field is similar to that found in a static bath except that the acceleration due to gravity "g" is replaced by a radial gravity acceleration.

To date, the most effective use of this principle has been obtained with devices that rotate a liquid or suspension within a stationary enclosure in order to create radial gravity force. When a slurry is injected into a cylinder in an involuted manner, laminar circular flow will be achieved and heavier particles will be moved outward. This process will be more effective if the flowing medium flows in a laminar manner. This means that all particles in the slurry layer have the same angular velocity and there is no relative movement of the particles with respect to each other. The only exception is slow outward drift of heavier particles. After leaving the cylinder, the flow stream possesses particle distribution by mass. Heavier particles are closer to the cylinder wall, while lighter particles are equally dispersed over a stream volume.

C. Open Gradient Magnetic Separation

Open gradient magnetic separation (OGMS) is a generic term used to describe any process involving magnetic separation achieved by particle deflection in non-uniform magnetic fields. OGMS is based on the magnetic force acting on a small particle in an inhomogeneous field and can be described as:

$$F_m = V_p J_p \nabla B_o / \mu_o \quad (1)$$

where:

$F_m$ is the magnetic force $V_p$ is the volume $J_p$ is the magnetic polarization of the particle $\nabla B_o$ is the gradient of the external magnetic field $\mu_o$ is the permeability of the medium.

$J_p$ can be express as:

$$J_p = \frac{\chi}{1 + \chi D} B_o \quad (2)$$

where:

X is the magnetic susceptibility of the particle;

D is the demagnetizing factor of the particle, and is $0 < D < 1$; and $B_o$ is the magnetic flux density.

For para-magnetic particles, $D << 1$, therefore $J_p \cong \chi B_o$, and equation (1) becomes:

$$F_m = V_p \chi B_o \nabla B_o / \mu_o \quad (3)$$

For ferri- and ferro-magnetic particles, $\chi$ will be dependent on the magnetic field, and $J_p$ usually reaches a saturation value, $J_{ps}$, in a relatively low field. Therefore, from equations (1), (2) and (3), we can see that efficient separation will occur if the magnetic flux density $B_o$, and its gradient $\nabla B_o$ are sufficiently high.

Hundreds of different kinds of magnetic separators have been constructed in the last two centuries. In these separators, the necessary magnetic conditions are obtained either by using the field and the gradient of a permanent or an electromagnet, or by placing in the homogeneous field secondary ferro-magnetic particles that give rise to field gradients around them. In the latter case, the gradients are often several orders of magnitude higher than in the former, but the resulting force is of shorter range because the maximum field is limited.

Open-gradient magnetic separators belong to the first group. The field and its gradient are produced by a suitable arrangement of magnets. The range of the force is of the order of a few centimeters. The operating principle of the separators is that a beam of particles flow through the magnetised area and is split into two or more parts. The force that deflects the particles is often modest, but due to the relatively long residence time in the field, it provides a continuous separation without particles being accumulated in the magnetized space.

The degree of success of OGMS depends upon the deflection imparted to the particles. This, in turn, depends upon four factors:

(i) the particles themselves (size, magnetic susceptibility, density);

(ii) the retention time of separating forces acting on particles;

(iii) the magnitude and geometry of the non-uniform magnetic field; and (iv) the geometry of magnetic and non-magnetic discharge posts.

One possible configuration provides for dry separation of ore particles, wherein the particles are made to fall through a magnetic field. As the particles fall, they are deviated by their relative attraction to, or repulsion from, the poles, and the resultant stream of ore is divided in two or more components by separating boxes.

In wet-magnetic separators, one design requires the positioning of a long rectangular channel adjacent to a magnet. The slurry is then fed through the channel, and separation occurs as the particles are influenced by the magnetic field.

Other types of OGMS are continuous units employing specially designed magnets to generate strong field gradients in a relatively large, open working volume, in which flowing slurry is effectively split into magnetic and non-magnetic streams (GB Patent 1,322,229, Jul. 4, 1973).

A further type of OGMS is a helical flow superconducting magnetic ore separator consisting of a superconducting dipole with a cylindrical annular slurry channel around one section [M. K. Abdelsalam, IEEE Transactions on Magnetics, Vol. Mag. 23, No. 5, Sep., 1987]. Helically flowing particles are forced outward due to the centrifugal force, and this is in turn opposed by magnetic forces on the magnetic particles. When a slurry flows helically in the annulus, non-magnetic particles experience a radially outward centrifugal force. Magnetic particles, on the other hand, experience an inward magnetic force in addition to the outward centrifugal force. Separation is thereby achieved if the magnetic force is strong enough to deflect the magnetic particles inward.

In the latter arrangement, magnetic forces act in opposite directions to the centrifugal forces, thereby substantially reducing the separation power of the apparatus. When the magnetic force equals the centrifugal force, no separation occurs since the magnetic particles do not experience any deflecting force. Therefore, the magnetic force needed must be substantially greater than the centrifugal forces generated in the apparatus.

SUMMARY OF THE INVENTION

According to an aspect of the invention, a process for separating particles in a slurry based on different physical, magnetic and/or chemical properties of the particles, the slurry including a mixture of solid particles and/or liquid particles which are immiscible in the slurry. The process comprises:

i) introducing a stream of the slurry into a cylindrical chamber having a cylindrical inner wall, the chamber being vertically oriented and closed at its lower end and open at its upper end, the stream being introduced near the first end at an incline and tangentially of the chamber to develop a spiral flow of the stream along the chamber inner wall toward the open end, ii) introducing the stream in sufficient volume and pressure to develop a vortex in the slurry which extends downwardly from the chamber upper end, iii) introducing air into the stream during at least a portion of its upward travel, the air being introduced to the stream through means located at the chamber inner wall and for developing the air bubbles which move into the stream, iv) the chamber being of a height sufficient to provide a residence time in the chamber which permits a separation of particles on their physical, magnetic and/or chemical properties with at least lighter hydrophobic particles combining with air bubbles and moving inwardly towards the vortex and at least heavier particles under influence of centrifugal forces of the spiral flow, moving outwardly towards the chamber inner wall, the stream developing into a whirlpool at the chamber upper end, v) directing the whirlpool stream outwardly at the open end into a catch basin surrounding the open end, the whirlpool stream swirling outwardly as the stream flows into the catch basin having a liquid level proximate the open end to permit the air bubbles to float toward a peripheral edge of the catch basin, vi) separating the floating air bubbles with lighter hydrophobic particles from the heavier particles by collecting outwardly floating air bubbles from an upper zone of the catch basin, while the heavier particles sink downwardly of the catch basin and removing the heavier particles from a lower zone of the catch basin to effect the separation.

According to another aspect of the invention, an apparatus for separating particles in a slurry based on different physical, magnetic and/or chemical properties of the particles, the slurry including a mixture of solid particles and/or liquid particles which are immiscible in the slurry.

The apparatus comprises when in its vertical orientation:

i) a cylindrical tube defining an interior cylindrical chamber with a cylindrical inner wall, and a closed lower end, ii) the inner wall having along at least a minor portion thereof and extending therearound, means for introducing gas bubbles into the inner chamber as a liquid slurry passes over the gas introducing means, iii) means for introducing a stream of slurry tangentially of and inclined relative to, the inner wall, the stream introducing means being positioned in a lower zone of the chamber to direct a slurry stream in a spiral manner at the incline, iv) a catch basin surrounding an open upper end of the chamber to receive slurry overflowing the open upper end, v) the upper end having a smoothly curved edge portion to facilitate a smooth transition in flow of the slurry from a vertical direction to an outward direction as slurry overflows into the catch basin, vi) means for collecting froth generated in the slurry by bubbles introduced by the gas introducing means, the froth collecting means surrounding the catch basin, a weir being provided around the catch basin to define an overflow for froth floating outwardly of the catch basin, whereby froth overflowing the weir is collected in the froth collecting means, vii) the catch basin having an outlet in its lower portion to permit removal of sinking particles of liquid, viii) the froth collecting means having an outlet to permit removal of froth from the collecting means, ix) the catch basin outlet having means for controlling flow of liquid to maintain in the catch basin an acceptable height of liquid to permit froth to overflow the weir.

BRIEF DESCRIPTION OF THE DRAWINGS

Preferred embodiments of the invention are shown in the drawings wherein

FIG. 5 is a detail of the section of FIG. 4 demonstrating the vortex of slurry located therein.

FIG. 6 is an enlarged portion of FIG. 5 showing contact of gas bubbles with particles in the slurry.

FIG. 7 is an alternative embodiment of the invention showing the positioning of magnets to develop a magnetic field within the separator.

FIG. 8 is a section along the lines 8–8 of FIG. 7.

DETAILED DESCRIPTION OF THE PREFERRED EMBODIMENTS

Figure 1:
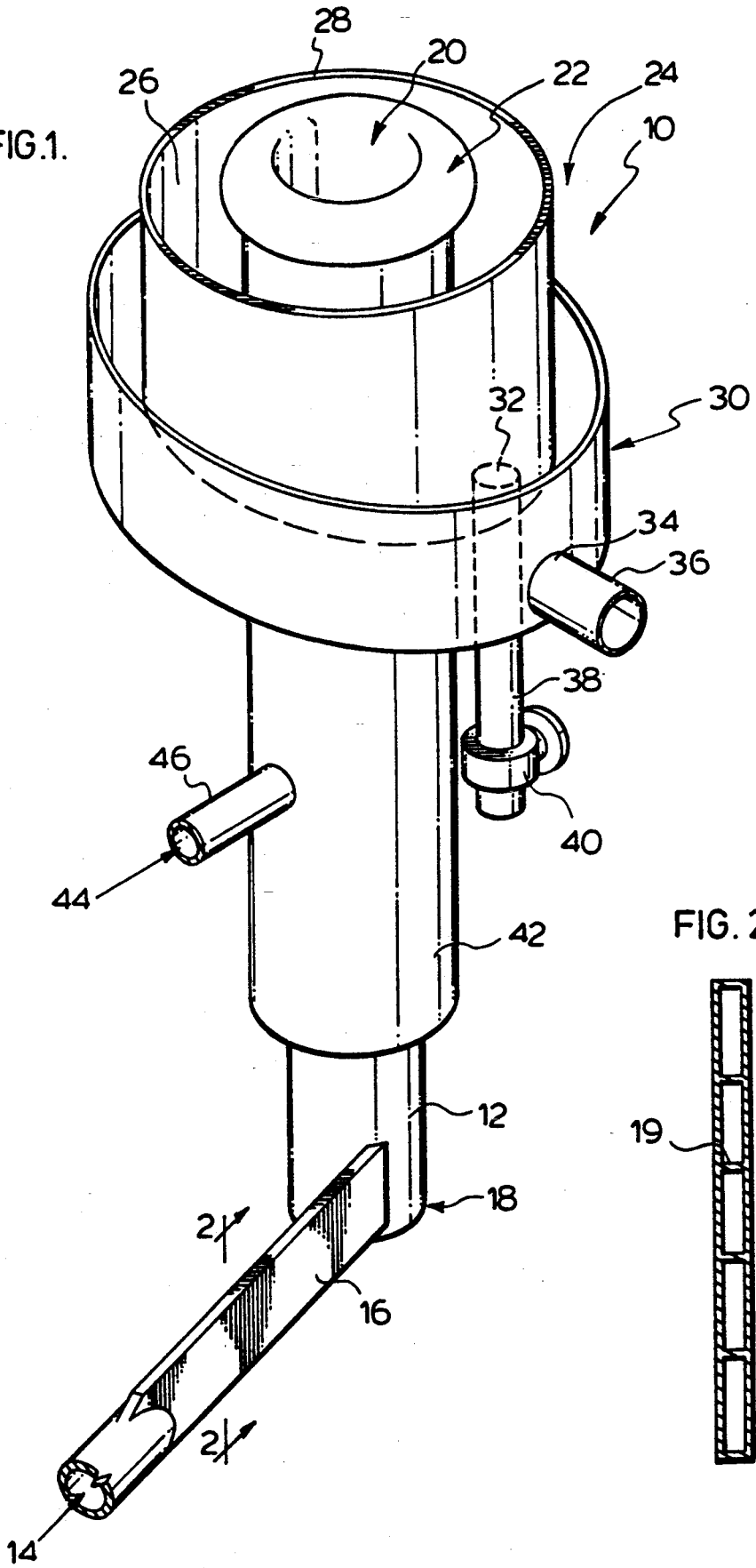
FIG. 1 is a perspective view of the apparatus for effecting a separation of particles in a liquid slurry.

Preferred aspects of the invention will be discussed with reference to embodiments shown in the drawings, however it is appreciated that the process of this invention may be implemented in a variety of ways to achieve separation of different types of particles in the incoming slurry stream. We have found that the process and apparatus of this invention is particularly suitable for separating slurries containing liquid hydrocarbons and in particular mixtures of bitumen with bitumen covered sands. The process is equally applicable to separation of mineral ores, coal and other particulate systems which may be carried in an aqueous or other liquid vehicle.

Unlike the system of applicant's published PCT application WO91/15302 the process and apparatus according to this invention provides for an upward flow of the slurry with consequent migration of bubbles to the inside of the vortex where at the open upper end of the separation chamber the stream is allowed to overflow in a manner which provides for continued flotation of the air bubbles. Hence, separation is effected by centrifugal and/or magnetic forces acting on the stream followed by principles of separation by flotation of bubbles to form a froth thereby separating particles attached to the bubbles from particles which remain in the slurry stream which have overflowed into the catch basin.

With particular reference to FIG. 1, the apparatus 10 comprises a cylindrical chamber 12 which when in use is vertically oriented. The slurry to be introduced into the system is directed under pressure in the direction of arrow 14 through conduit 16 which is rectangular in cross-section. Conduit 16 is positioned tangentially of an incline relative to the cylindrical chamber 12. The lower end 18 of the chamber 12 is closed so that all fluids introduced to the chamber 12 flows upwardly to the open end 20 of the chamber. The liquid is allowed to overflow the upper edge 22 of the chamber into a catch basin 24. The catch basin defines an annular cavity 26 which is filled with treated slurry. Froth, as it overflows from the central portion of the central chamber 20, flows over the weir 28 defined by the peripheral edge of the catch basin 24 and is collected in a froth collector 30. The outlet 32 is provided in the catch basin 24 for removal of particles which sink. The froth which overflows and is collected in the froth collector 30 is removed through outlet 34 defined by conduit 36. Connected to outlet 32 is conduit 38 which includes a valve 40. The valve 40 is adjusted to maintain adequate liquid level in the catch basin 24 to provide for overflow of froth over the weir 28.

Located circumferentially of the cylindrical inner chamber 12 is a plenum 42. Pressurized air is introduced in the direction of arrow 44 through inlet 46. Pressurized air, as will be discussed in FIG. 2, enters through a porous mesh to introduce bubbles into the slurry as it flows upwardly of the cylindrical chamber 12.

Figure 2:
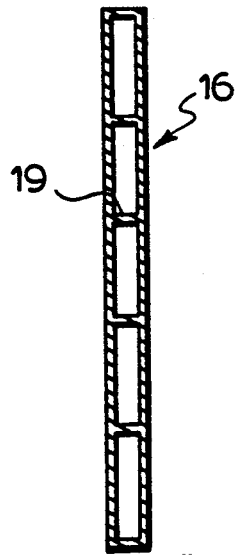
FIG. 2 is a section along the lines 22 of the conduit for introducing slurry to the separation apparatus of FIG. 1.

The stream of slurry is preferably injected in a manner which reduces turbulence in the introduced stream. To approximate laminar flow, the rectangular conduit 16 as shown in FIG. 2, may include flow straightening veins 19 which extend longitudinally of the conduit 16 to reduce turbulence in the stream before introduction to the chamber 12. Ideally, the stream approximates laminar flow as the stream exits the conduit 16. However, it is appreciated that for certain types of separation, mild turbulence in the flow is acceptable while achieving the desired degree of separation.

Figure 3:
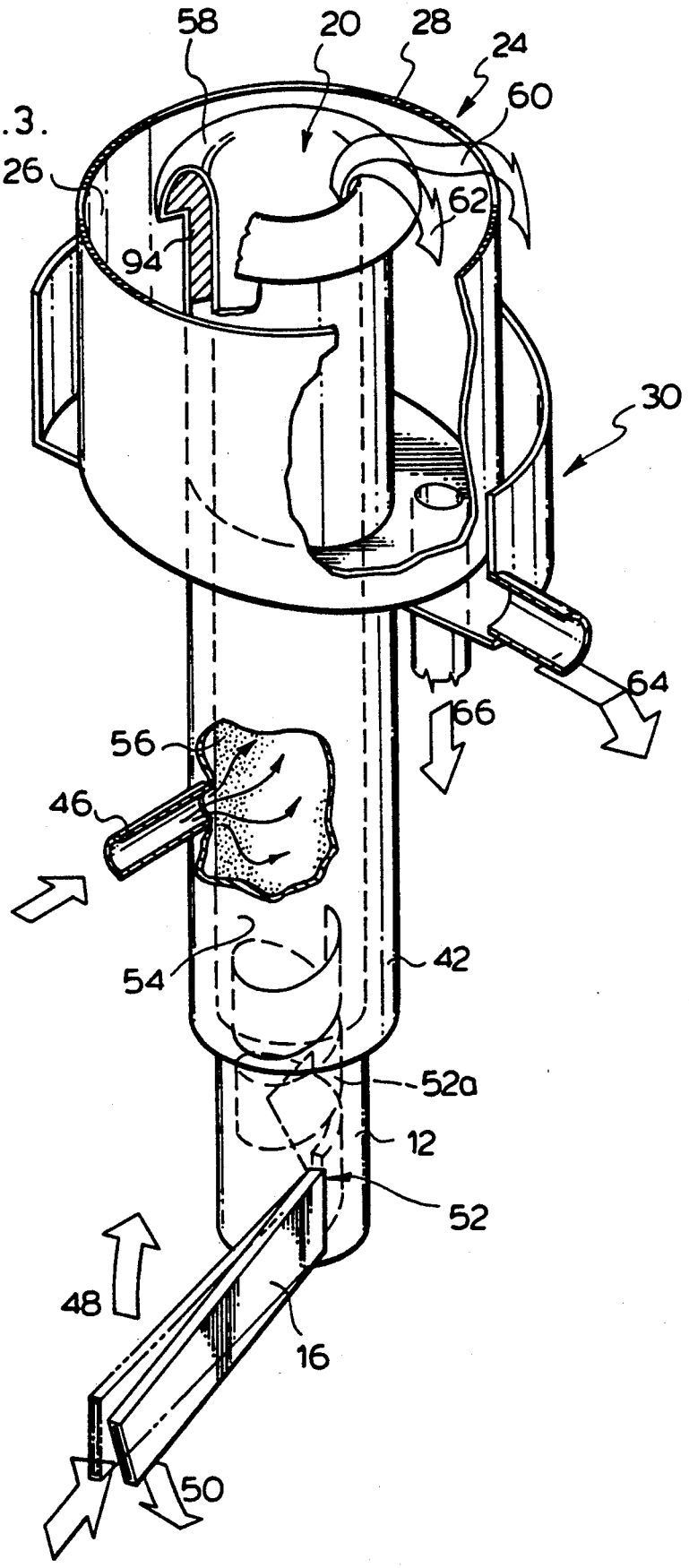
FIG. 3 is a perspective view of the apparatus of FIG. 1 with portions thereof removed to show certain details of the apparatus.

For any particular diameter of cylindrical reactor, the conduit 16 is fixed relative to the cylindrical chamber 12. FIG. 3 demonstrates in principle how the relative incline of the conduit 16 can be adjusted vertically in the direction of arrows 48 or 50. Variation in incline determines the angle at which the stream 52 progresses upwardly of the inside wall 54 of the cylindrical chamber 12. Ideally, the spiral stream 52 progresses upwardly of the inner cylindrical wall of the chamber without intersecting its adjacent lower portion of the spiral as designated at 52*a*. This ensures a continued upward travel of the stream in a spiral manner while minimizing turbulence in the flow of the stream.

As the stream progresses upwardly of the inner circular chamber air bubbles are introduced into the stream to effect a separation of particles which are attracted to the air bubbles. It is appreciated that a variety of gas bubble introduction mechanisms may be provided which communicate with the inner surface of the cylindrical chamber. For purposes of discussion and illustration with this particular embodiment of FIG. 3, the plenum 42 envelops a fine mesh 56. Air is introduced through tube 46 and pressurizes the chamber within the plenum 42 whereby air slowly diffuses through the porous mesh 56 to introduce bubbles into the slurry stream in a manner to be discussed in more detail with respect to FIGS. 5 and 6. As will become more apparent with respect to the discussion of the embodiment of FIG. 4, the stream as it emerges from the upper end 20 of the cylindrical chamber 12 is allowed to overflow into the annular recess 26 of the catch basin 24. To provide for a smooth transition in the flow of the stream from the vertical orientation to an outward orientation the upper edge 58 of the cylindrical chamber 12 is smoothly curved so as to minimize turbulence in the stream as it changes direction in flow. By minimizing the turbulence induced into the transition phase for the stream flow, the froth which collects on the inside of the swirling layer remains floating as indicated by arrow 60 and thereby overflows the weir edge 28 whereas the heavier particle or particles in the slurry which are not attached to the air bubbles flows downwardly in direction of arrow 62. The particles then carried with the froth overflowing weir 28 are removed in a direction of arrow 64 for subsequent processing and/or discard. Similarly, the heavier particles which are carried downwardly in a direction of arrow 62 are removed in the direction of arrow 66 for processing and/or discard. In this manner, a very simple yet effective collection of the desired particles either in the material which floats with the air bubbles and flows over into the froth collector 30 or the heavier particles which are retained in the catch basin 24 are thereby separated and recovered.

Figure 4:
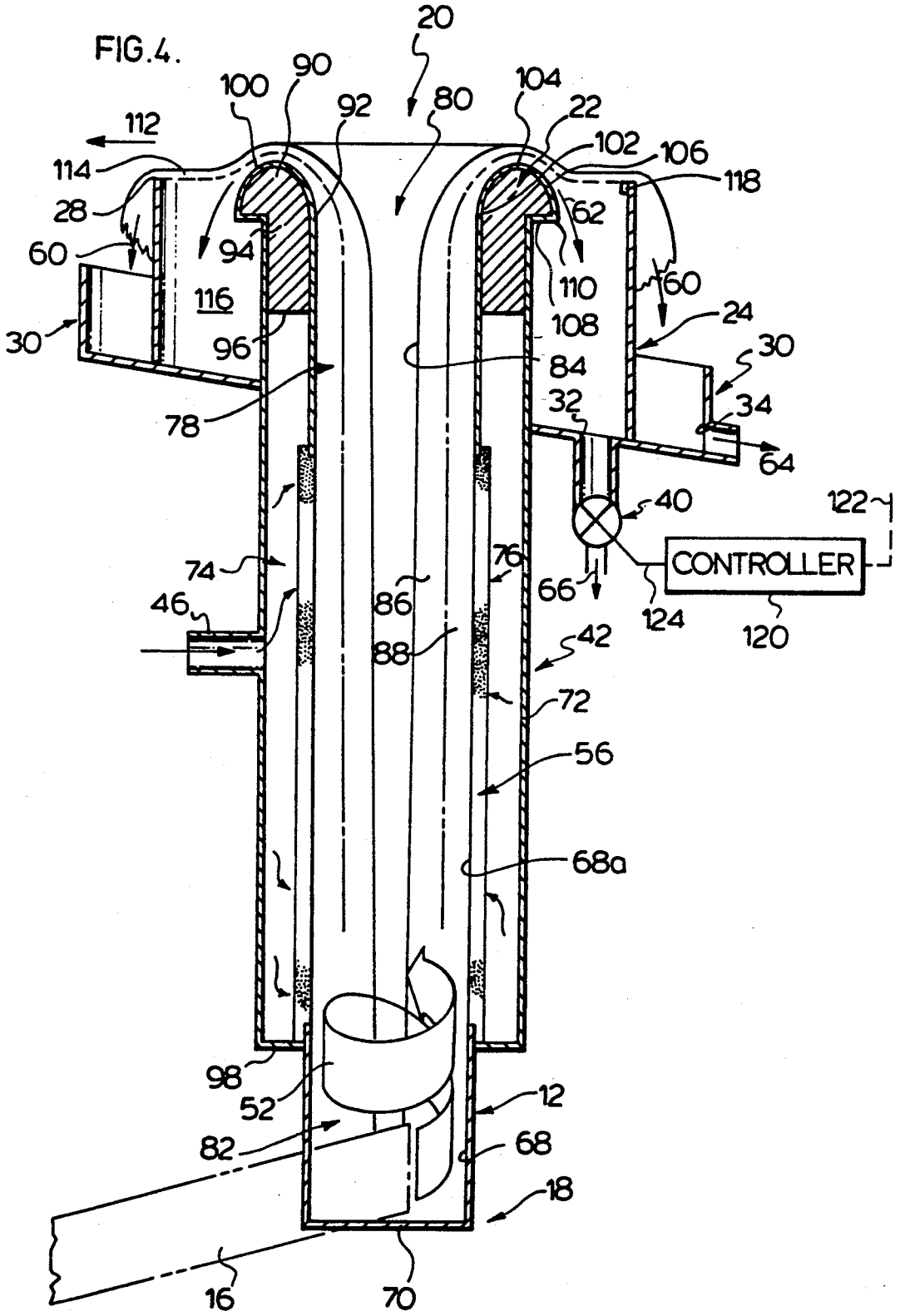
FIG. 4 is a longitudinal section of the apparatus of FIG. 1.

As shown in FIG. 4 a preferred construction for the separator apparatus is shown in section. The cylindrical chamber 12 has an inner cylindrical wall 68 which, when the apparatus is in use extends vertically as shown in FIG. 4. The lower end 18 of the cylindrical chamber is closed by a circular plate 70 so that all fluids or liquids introduced into the circular chamber 12 flow upwardly to the open end 20 of the cylindrical chamber. As already explained, the conduit 16 for introducing the slurry stream is inclined so that the stream 52 flows upwardly in a spiral manner confined by the circular inner surface 68 of the cylindrical chamber 12. The incline of the conduit 16 is such to ensure that the stream 52 spirals upwardly without interfering with the lower adjacent stream to minimize turbulence in the stream as it flows upwardly.

As a continuation of the inner surface 68 of the cylindrical chamber the fine mesh generally designated 56 is flush with the inner surface 68 to define a continuing inner surface 68*a*. The plenum 42 is defined by an outer shell 72 which encloses the hollow cylinder of fine mesh 56. The shell 72 defines an annular plenum 74 into which the pressurized air is introduced through inlet 46. Sufficient air pressure is developed in plenum 74 to cause the air to slowly diffuse through the fine mesh 56 in the direction of arrows 76 thereby introducing air bubbles into the upwardly flowing stream 52 of the slurry.

The slurry is introduced through conduit 16 in sufficient volume and at sufficient velocity to develop at least in the upper zone, generally designated 78, a vortex, generally designated 80. With sufficient volume and/or velocity, vortex 80 may extend from the upper zone 78 of the circular chamber down to the lower zone 82 of the cylindrical chamber. As shown in FIG. 4, the inner surface 84 of the vortex is formed primarily of the air bubbles which have migrated towards the center of the spiral stream, that is, the inner surface 84 of the vortex. Schematically, the developed inner annular layer of bubbles is defined by region 86 whereas the outer layer of slurry liquid containing at least the heavier particles is designated 88. By way of this cylindrical chamber, an air-sparged separation of particles in the introduced slurry is achieved. Quite surprising as discovered in accordance with this invention, a smooth transition of the vertically oriented flow of slurry to an outward flow allows the innermost froth layer 86 to continue in an undisturbed manner and overflow into the froth collector 30. With reference to FIG. 4, the upper edge 22 of the cylindrical chamber is defined by a cap 90 which according to this embodiment is a continuation of the shell 72 into the inner surface 92 for the inner wall 68. The inner surface 92 is then continuous with the fine mesh 56. To seal off the annular plenum 74 a suitable plug material 94 is provided or at least a plate 96 to close off the plenum 74. The lower end of the plenum 74 is closed off by the annular shaped plate 98. The shell material 72 is shaped to define a smoothly rounded end portion 100. As shown in FIG. 4 the smoothly rounded portion is parabolic in cross-section and comprises an inner edge portion 102, an upper edge portion 104, and an outside edge portion 106. The shell 72 is shaped at 108 to provide a lip 110 for the smoothly rounded upper edge portion 22. As shown in FIG. 4, the innermost layer 86 progresses smoothly from a vertical orientation in travel to an outward orientation in travel as indicated by arrow 112 so that the froth layer 114 floats over the weir edge 28 into the froth collector 30 in the direction of arrow 60. As the froth layer 114 traverses outwardly over the catch basin 24, the liquid level 116, as retained in the catch basin 24, allows for additional gas bubbles to float upwardly into layer 114 to further enhance the froth flotation of attached particles from the remaining particles in the liquid 116. Hence, the radial extent of the catch basin 24 may be varied to enhance the separation of the froth layer, it being understood, however, that the extent of the radial distance for the catch basin cannot extend beyond the distance which the froth travels due to the transition in flow of the froth from a vertical orientation to an outward orientation.

As is appreciated by those skilled in the art, the level of liquid 116 in the catch basin 24 may be sensed by sensor 118. Sensor 118 can provide output which is connected to controller 120 via input line 122. Controller 120 has output via line 124 to servo control valve 40. By standard feedback techniques the controller 120 opens and closes the valve 40 so as to maintain the desired liquid level in the catch basin 24 to optimize the collection of froth overflowing the weir 28.

As schematically shown in FIG. 4, the stream 52 spirals upwardly of the circular chamber 12. The inclination of the conduit 16 is such to ensure that the spiral flow does not interfere with adjacent layers. However, the flow of liquid is such that distinct ribbons of flow is not per se visible. Instead, the stream melts together to form an annular cylindrical layer of slurry travelling upwardly along the inner surface 68 of the inner cylindrical chamber. Hence, a top view of the unit 10 in operation reveals a whirlpool-like flow for the stream as the liquid flows upwardly of the inner wall of the chamber and transforms from an upward flow to an outward flow of the liquid. As the whirlpool expands over the upper edge 100 of the open end of the cylindrical chamber, the froth spirals outwardly towards the weir 28. Correspondingly, the liquid spirals downwardly of the catch basin 24 towards the outlet 32. By virtue of this smooth transition in the froth layer from an upward flow to an outward flow quite surprising, as will be demonstrated by the following Examples, very high recoveries of desired particles from the slurry mixture is achieved.

With reference to FIG. 5, the development and incorporation or inclusion of air bubbles in the stream is discussed. Pressurized air in plenum 74 migrates or diffuses through the fine mesh 56 to develop at the mesh inner surface 68*a* minute bubbles 126. The slurry stream as it flows upwardly in a direction of arrow 52 develops a thickness 128 circumferentially around the vessel inner wall 68*a*. The vortex 80 extends centrally of the cylindrical chamber along the longitudinal axis 130 of the chamber. The innermost surface of the slurry is therefore defined by the inside surface 84 of the vortex. Air is introduced through the fine mesh or porous vessel wall and is sheared into numerous bubbles by the high velocity swirl of the slurry as shown in FIGS. 5 and 6. The bubble generation mechanism accomplished by the fine mesh 56 is a two-stage process. Air migrates through the micro channels of the porous cylinder 56 as shown at 132. When leaving the pore, air creates a small cavity 134 in the slurry as shown in FIG. 6. The cavity grows until the surface tension is smaller than the shearing force of the flowing slurry. Once a bubble 126 is sheared off from the surface 68*a* of the cylinder, it begins to flow with the slurry at the same speed as particles in the slurry. The radial gravity force creates an upward hydrostatic pressure. This causes the bubble to move towards the inner surface 84 of the slurry in the direction of arrow 136. The bubble possesses velocity which has two components: 1) tangential component which is equal to the tangential velocity of slurry; and 2) radial velocity which is due to the buoyancy. This means that the bubble travels perpendicularly to the motion of the slurry thereby increasing the probability of collision with particles in the slurry. The radial gravity field creates relatively high pressure in the slurry. The bubbles will move relatively fast towards the vortex 80 in the centre of the cylinder. The bubbles collide with the particles, and at least hydrophobic particles become attached to the bubbles. The bubble-particle agglomerate 140 is transported radially towards the inner surface 84 of the slurry layer and travels upwardly in the direction of arrow 138. On the other hand, the hydrophilic particles 142 generally remain radially outwardly of the slurry layer, and thus continue to move in the swirl direction along the porous vessel wall 68*a* until they are discharged at the upper end of the vessel.

The fine mesh 56, which constitutes the porous portion of the vessel wall 12, may be constructed of a variety of materials. The fine mesh may be a screen product having rigidity and which defines a reasonably smooth surface 68*a* to maintain centrally laminar flow in the slurry. A variety of screen meshes are available which will provide such porosity. Other materials include sintered porous materials of metal oxides which have the necessary structural strength yet provide a relatively smooth surface 68*a*. It is appreciated that other forms of porous materials are available such as sintered, porous, stainless steel of controlled porosity, for example, 316LSS. To enhance the separation of the particles 142 from particles 144 having different characteristics, a magnetic field may be used where the particles may have para-, ferri- or ferro-magnetic characteristics. With reference to FIG. 7 and 8, a magnetic field is produced in the cylindrical chamber 12 which extends along its length. The magnets which produce the magnetic field may be located in the plenum 74. According to FIG. 7 and 8, four magnets 146, 148, 150 and 152 are provided. The quadrapole configuration for the magnets develops a magnetic field indicated by arrows 154 which attract ferri- and ferro- magnetic particles towards the inside surface 68*a* of the cylindrical chamber 12.

The poles of the magnets are oriented toward the axis 130 of the apparatus, and the quadrapole configuration provides radial magnetic field 154 with no components along the axis 130 and with a net magnetic field at the centre 130 of the vessel equal to zero. It is appreciated that the magnetic field can be created by either permanent magnets or by electromagnets. The operation of the apparatus in a magnetic field requires, as already described, that the slurry be introduced into the cylindrical vessel through the tangential inlet 16. The slurry forms the layer on the inside surface 68*a* of the porous wall. Air is continuously sparged through the porous wall and into the thin swirl layer. Bubbles formed in the slurry collide with the particles in the slurry and form bubble particles aggregate with the hydrophobic particles of the slurry. Due to the circular motion of the slurry and due to the radial geometry of the magnetic field and magnetic field gradient, the slurry flow is always perpendicular to the magnetic force and to the flow of bubbles. Generally, there are two different forces acting on a hydrophilic para-magnetic or ferro-magnetic particle in the slurry. It will be appreciated that any solid particle placed in a magnetic field will be affected by it in some way. Solids may be classified into three categories depending on their magnetic properties:

1. diamagnetic particles, which are repelled by a magnetic field;
2. para-magnetic particles, which are attracted by a magnetic field; and
3. ferro-magnetic particles, which are most strongly attracted by a magnetic field.

Although the process of this invention is particularly suited to the separation of discrete solid particles in coal and/or minerals, the process may also be used to separate biological particulate matter such as cells, labelled proteins and fragments thereof, solid and semi-solid waste materials and the like, particularly when magnetic particles are employed in the separation process.

During operation of a flotation apparatus, there are generally two forces acting on the hydrophilic para-magnetic or ferro-magnetic particles. These two forces are the centrifugal force, $F_c$, and the magnetic attraction force, $F_m$. The centrifugal force is due to the swirling motion of the slurry along the inside porous wall of the vessel, whereas the magnetic attraction force is due to the magnetic force of the quadrapole magnet acting on the particles perpendicularly to the flow of the slurry. These two forces act in the same direction, that is, radially towards the outside of the cylindrical vessel. Therefore, the total force acting on the hydrophilic and/or magnetic particles is the sum of the centrifugal force and the magnetic attraction force, and it acts radially outwards of the vessel. These resultant forces cause these particles to remain in the swirl-layer and to be eventually discharged into catch basin 24. On the other hand, there are generally three forces acting on the hydrophobic and diamagnetic particles that have become attached to the air bubbles. These three forces are:

1. the hydrostatic force $F_h$;
2. the magnetic repelling force, $F_r$; and
3. the centrifugal force, $F_c$.

The hydrostatic force is the force of the air bubble/particle aggregate that causes it to be transported radially inwardly towards the cylindrical axis. The magnetic repelling force, due to the quadrapole configuration of the magnet, acts on these particles in a direction radially inwardly towards the cylindrical axis. The third of these forces, the centrifugal force, is due to the swirling motion of the slurry, and acts on the particles in a radially outward direction from the cylindrical axis. For hydrophobic and diamagnetic particles that are not too large and have a specific gravity smaller than those of hydrophilic, the hydrostatic and magnetic repelling forces are greater than the centrifugal force, thereby causing a net force acting on these particles inwardly towards the cylindrical axis of the vessel. This resultant force causes these particles to be transported upwardly with the swirl inner layer of froth.

From the above, it will be appreciated that the present invention can additionally provide magnetic repelling forces acting on the hydrophobic and diamagnetic particles, thereby allowing for efficient separation of smaller sized hydrophobic particles from the larger sized particles. Similarly, the addition of a magnetic attraction force acting on the hydrophilic para-magnetic or ferro-magnetic particles allow for the efficient separation of finer hydrophilic particles which would otherwise have been entrained by the air bubbles out of the swirl layer and into the froth core.

Hence, on the hydrophobic and diamagnetic particles which have formed aggregates with the air bubbles, there are generally three forces acting on them. They are the hydrostatic or buoyancy force, $F_h$, which is the force transporting the bubble particle aggregate towards the inner surface of the slurry stream, the magnetic repelling force, $F_r$, and the radial gravity force $F_c$. The hydrostatic and the magnet repelling forces act on the particles in a radially inward direction whereas the centrifugal force acts on the particles in a radial outward direction. The combined action of these three forces is a net force acting radially inward towards the centre of the cylindrical vessel.

The above described process is more efficient when the medium or slurry flows in a laminary manner. The laminar flow is characterized by constant angular velocity for all flowing medium particles, and by no significant relative movement of particles in with respect to each other. Turbulent flow is characterized by the distribution of particle velocities (moduli and directions), with a mean value parallel to flow. The laminar velocity of particle will have two components, $V_1$ parallel and $V_2$ perpendicular. These two components create a spiral flow of medium in the form of the swirl layer. When the swirl layer reaches the upper end of the cylinder, the vessel wall no longer contains the swirl flow so that the slurry stream transforms to an outward flow in a spiral manner.

The apparatus according to this invention can be modified depending upon the type of particles to be separated. It has been found that this apparatus has been particularly effective in causing a separation of bitumen from tar sands. A slurry is developed which includes water, particles and viscous fluid comprising sand and bitumen. The system according to this invention can provide up to 80% recovery of the bitumen compared to considerably lower recoveries in the range of 30% for separation apparatus such as disclosed in applicant's published PCT application WO91/15302. With this apparatus the separated material stays on top and flows over the edge of the catch basin. In this way the air which has been sheared into the slurry now works entirely towards recovery during the additional flotation stage achieved in the catch basin. It has been found that for every unit volume of slurry treated approximately two volumes of air can be introduced to the slurry which provides a fairly high ratio of air to slurry. It is appreciated of course that wherever or whenever air is mentioned in the specification that other gases may be substituted for air depending upon the types of particles to be treated. It is also appreciated that the diameter of the treatment chamber may vary depending upon the required throughput and types of materials to be separated. Tests have demonstrated that diameters in the range of 2 inches, 4 inches, 6 inches and greater can be used to process very high flow rates of slurry such as in the range of 2.2 liters per second for a chamber diameter of 2 inches. It is understood that the system may be developed and rendered mobile by mounting the system in a suitable trailer or railroad car.

The following data demonstrates the efficacy of this system as applied in the recovery of various types of particles such as coal and bitumen.

EXAMPLE NO. 1

The "run of the mine" medium volatile butiminuous coal was screened and -100 mesh fraction was collected. A 2500 1 batch of slurry was prepared @5% by wt. solids. 1200 ppm kerosene and 1500 ppm of MIBC were added to the slurry. The slurry was run through a 2 inch diameter separator unit of FIG. 4, the diameter being that for the internal diameter of chamber 12. The slurry was introduced to the unit through conduit 16 at the rate of 1.2 l/s with the air flow through the porous wall 56 in the range of 2 1/s. The concentrate and tailings were collected and analyzed.

The following table summarizes the average performance with comparison to recovery from a standard mechanical froth flotation cell operated under normal conditions.

| | Feed Sample | Concentrate | Recovery |
|---|---|---|---|
| Average unit performance according to this invention | 12% | 8% | 86–88% |
| Average froth flotation performance for the same coal in a standard froth flotation cell | 12% | 7.5% | 85% |

EXAMPLE NO. 2

Illinois No. 6 Coal

The same procedure of Example 4 was performed with prescreened Illinois No. 6 coal. The following table summarizes the performance of the unit of this invention.

| Fraction size based on screen mesh sizing | Feed Sample (52) Direct (Wt %) | Ash (Wt %) | Sulfur (Wt %) | Pyritic Sulfur (Wt %) | Heating Value (Btu/lb) |
|---|---|---|---|---|---|
| 100 M retained | 19.9 | 9.88 | 3.74 | 1.18 | 12682 |
| 400 M retained | 55.5 | 8.37 | 3.74 | 1.09 | 12775 |
| 400 M passing | 24.6 | 16.46 | 4.08 | 1.80 | 11608 |
| TOTAL | 100.00 | 10.66 | 3.82 | 1.28 | 12469 |

Product Sample (60)
Feed Rate = 1.10 l/s to unit Kerosene = 2875 ppm
Air Rate = 2 l/s to unit MIBC = 1150 ppm

| Size Fraction of Recovered Stream | Direct (Wt %) | Ash (Wt %) | Sulfur (Wt %) | Pyritic Sulfur (Wt %) | Heating Value (Btu/lb) | Yield in Required Stream (Wt %) | Energy Recovery (%) |
|---|---|---|---|---|---|---|---|
| 100 M retained | 9.8 | 7.15 | 3.13 | 0.75 | 13210 | 35.8 | 38.2 |
| 400 M retained | 63.6 | 6.55 | 2.98 | 0.78 | 13625 | 83.2 | 86.4 |
| 400 M passing | 26.6 | 8.18 | 3.37 | 1.22 | 12865 | 78.5 | 87.0 |
| TOTAL | 100.0 | 7.04 | 3.10 | 0.89 | 13153 | 72.6 | 76.6 |

EXAMPLE NO. 3

Tar Sands

The 25% solids slurry of medium grade Athabasca tar sans was prepared at 55° C. The slurry was then pumped through the 2" of FIG. 4 at the rate of 1.73 l/s with 3.4 l/s of air. The flow rate of concentrate (60) and tailing stream (62) was measured and samples were collected and analyzed. The performance of the unit is summarized in the following table.

| Slurry Makeup | % Bitumen | % Water | % Solids |
|---|---|---|---|
| Average Concentrate Content (% by wt) | 36.7 | 38.8 | 24.6 |
| Bitumen Recovery in Stream (60) | 88% | | |
| Solids Rejection in Stream (62) | | | |

EXAMPLE NO. 4

Graphite

A 27% solids slurry containing graphite, chalcopirite, pentlandite, phyrotite and rocks was fed to a 4" ID chamber 12 of FIG. 4 at the rate of 31 Gpm and 4 cfm of air. The following table summarized the average performance.

| Stream Component | Content % by wt. in respective stream | Recovery % |
|---|---|---|
| COPPER | | |
| Feed (52) | 0.73 | |
| Concentrate (60) | 0.62 | 45 |
| Tails (62) | 0.87 | 55 |
| NICKEL | | |
| Feed (52) | 4.09 | |
| Concentrate (60) | 3.14 | 41 |
| Tails (62) | 5.25 | 59 |
| FERRUM | | |
| Feed (52) | 123.3 | |
| Concentrate (60) | 9.7 | 41 |
| Tails (62) | 16.3 | 59 |
| SULPHUR | | |
| Feed (52) | 9.2 | |
| Concentrate (60) | 7.1 | 41 |
| Tails (62) | 12.0 | 59 |

-continued

| Stream Component | Content % by wt. in respective stream | Recovery % |
|---|---|---|
| CARBON | | |
| Feed (52) | 20.2 | |
| Concentrate (60) | 43.8 | 73 |
| Tails (62) | 15.4 | 26 |

Although preferred embodiments of the invention are described herein in detail, it will be understood by those skilled in the art that variations may be made thereto without departing from the spirit of the invention or the scope of the appended claims.

We claim:

1. A process for separating particles in a slurry based on different physical, magnetic and/or chemical properties of said particles, said slurry including a mixture of solid particles and/or liquid particles which are immiscible in said slurry, said process comprising:

i) introducing a stream of said slurry into a cylindrical chamber having a cylindrical inner wall, said chamber being vertically oriented and closed at its lower end and open at its upper end, said stream being introduced near said closed lower end at an incline end and tangentially of said chamber to develop a spiral flow of said stream along said chamber inner wall toward said open end, ii) introducing said stream in sufficient volume and pressure to develop a vortex in said slurry which extends downwardly from said chamber upper end, iii) introducing air into said stream during at least a portion of its upward travel in said chamber, said air being introduced to said stream through means located at said chamber inner wall and for developing said air bubbles which move into said stream, iv) said chamber being of a height sufficient to provide a residence time in said chamber which permits a separation of particles on their physical, electrical and/or chemical properties with at least lighter hydrophobic particles combining with air bubbles and moving inwardly towards said vortex and at least heavier particles under influence of centrifugal forces of said spiral flow, moving outwardly towards said chamber inner wall, said stream developing into a whirlpool at said chamber upper end, v) directing said whirlpool stream outwardly at said open end into a catch basin surrounding said open end, said whirlpool stream swirling outwardly as said stream flows into said catch basin having a liquid level proximate said open end to permit said air bubbles to float toward a peripheral edge of said catch basin, vi) separating said floating air bubbles with lighter hydrophobic particles from said heavier particles by collecting outwardly floating air bubbles from an upper zone of said catch basin, while said heavier particles sink downwardly of said catch basin and removing said heavier particles from a lower zone of said catch basin to effect said separation.

2. A process of claim 1, further comprising directing said stream whirlpool over a smoothly curved upper edge of said chamber upper end as said whirlpool stream swirls outwardly in changing from a vertical direction of flow to an outward direction of flow.

3. A process of claim 2, wherein said smoothly curved upper edge is parabolic in cross-section whereby direction of flow is gradually converted from vertical to an outward direction.

4. A process of claim 1, wherein air is introduced along a major portion of its upward travel in said chamber.

5. A process of claim 4, wherein said air is introduced through a fine mesh to develop minute air bubbles in said stream.

6. A process of claim 1, wherein said stream is introduced at sufficient volume and pressure to develop said vortex from said chamber upper end down to where said stream is introduced.

7. A process of claim 6, wherein said stream is introduced as a thin stream which is rectangular in cross-section.

8. A process of claim 7 wherein said stream is introduced through a rectangular shaped channel, said channel being positioned tangentially to and at an incline to said chamber inner wall.

9. A process of claim 8 wherein flow straightening vanes are provided in said channel.

10. A process of claim 9 wherein said stream is introduced at a volume and a pressure to provide a laminar flow in said channel.

11. A process of claim 2 wherein said catch basin has an outlet in said lower region, said sinking heavier particles being removed through said outlet, controlling flow through said outlet to maintain said liquid level proximate said upper edge to ensure thereby smooth transition of stream flow from a vertical direction to an outward direction, said smooth transition permitting said bubbles located nearest said vortex to retain their relative position with respect to said heavier particles and float on said liquid in said catch basin.

12. A process of claim 11 wherein said floating bubbles are collected by permitting a froth developed by said floating bubbles to swirl outwardly over a circumferential weir provided around said catch basin periphery collecting overflowing froth in a froth collector provided around said weir.

13. A process of claim 11 wherein said stream is inclined at an angle which causes said stream to contact its adjacent lower portion of said spiral flow to provide thereby coverage of said chamber inner surface.

14. A process of claim 1 for separating a slurry comprising bitumen and tar sands.

15. A process of claim 1 for separating a slurry comprising mineral ore particles.

16. A process of claim 1 for separating a slurry comprising liquid hydrocarbons in water.

17. A process of claim 1 wherein a magnetic field is provided along said chamber to attract magnetizable particles toward said column inner wall.

18. Apparatus for separating particles in a slurry based on different physical, magnetic and/or chemical properties of said particles, said slurry including a mixture of solid particles and/or liquid particles which are immiscible in said slurry, said apparatus comprising when in its vertical orientation:

i) a cylindrical tube defining an interior cylindrical chamber with a cylindrical inner wall, and a closed lower end, ii) said inner wall having along at least a minor portion thereof and extending therearound, means for introducing gas bubbles into said inner chamber as a liquid slurry passes over said gas introducing means, iii) means for introducing a stream of slurry tangentially of and inclined relative to said inner wall, said stream introducing means being positioned in a lower zone of said chamber to direct a slurry stream in a spiral manner at said incline, iv) a catch basin surrounding an open upper end of said chamber to receive slurry overflowing said open upper end, v) said upper end having a smoothly curved edge portion to facilitate a smooth transition in flow of said slurry from a vertical direction to an outward direction as slurry overflows into said catch basin, vi) means for collecting froth generated in said slurry by bubbles introduced by said gas introducing means, said froth collecting means surrounding said catch basin, a weir being provided around said catch basin to define an overflow for froth floating outwardly of said catch basin, whereby froth overflowing said weir is collected in said froth collecting means, vii) said catch basin having an outlet in its lower portion to permit removal of sinking particles and liquid, viii) said froth collecting means having an outlet to permit removal of froth from said collecting means, ix) said catch basin outlet having means for controlling flow of liquid to maintain in said catch basin an acceptable height of liquid to permit froth to overflow said weir.

19. Apparatus of claim 18, wherein said stream introducing means comprises a rectangular in cross-section conduit extending through said chamber inner wall and tangentially of said inner wall, said conduit being inclined relative to a horizontal plane extending at 90° relative to a longitudinal axis of said chamber.

20. Apparatus of claim 19 wherein said incline ranges from 10° to 25° from said horizontal plane.

21. Apparatus of claim 19 wherein said means for introducing gas bubbles comprises a fine mesh around said inner wall and along a portion of said inner wall.

22. Apparatus of claim 21 wherein said fine mesh extends along a major portion of said inner wall.

23. Apparatus of claim 21 wherein said cylindrical chamber is surrounded by a plenum to enclose said fine mesh, means for pressurizing gas in said plenum to develop gas bubbles at said inner wall.

24. Apparatus of claim 18 wherein said smoothly curved edge portion is parabolic in cross-section.

25. Apparatus of claim 24 wherein said froth collecting means is an annular trough for receiving overflowing froth, said trough sloping towards said froth outlet to provide collection of froth.

26. Apparatus of claim 18 wherein said catch basin is sloped towards said catch basin outlet, means for sensing liquid level in said catch basin, said sensing means having input to said flow controller to varying flow proportional to height in said catch basin to maintain thereby a desired height of liquid in said catch basin during flow of slurry along said chamber.

27. Apparatus of claim 18 wherein means for producing a magnetic field along said chamber is provided outside said inner wall, said magnetic means attracting magnetizable particles toward said inner wall.

* * * * *